US005387908A

United States Patent [19]

Henry et al.

[11] Patent Number: 5,387,908

[45] Date of Patent: Feb. 7, 1995

[54] TRAFFIC CONTROL SYSTEM

[76] Inventors: Edgeton Henry, 16535 Monte Carlo La., Houston, Tex. 77026; Fitz Jackson, 11430 Bissonnet St., Houston, Tex. 77099

[21] Appl. No.: 879,848

[22] Filed: May 6, 1992

[51] Int. Cl.[6] ..... G08G 1/07

[52] U.S. Cl. ..... 340/916; 340/907; 340/927; 340/931

[58] Field of Search ..... 340/916, 907, 927, 926, 340/931, 914, 930; 116/63 R

[56] References Cited

U.S. PATENT DOCUMENTS

| | | | |
|---|---|---|---|
| 1,757,050 | 5/1930 | Johnson | 340/914 |
| 2,135,851 | 11/1938 | Sieveking | 116/63 R |
| 2,865,017 | 12/1958 | Heikes | 340/907 |
| 3,022,490 | 2/1962 | Dosal | 340/927 |
| 3,629,802 | 12/1971 | Clark | 340/931 |
| 3,641,487 | 2/1972 | Rogers et al. | 340/931 |
| 5,132,682 | 7/1992 | Higgins et al. | 340/931 |

FOREIGN PATENT DOCUMENTS

| | | | |
|---|---|---|---|
| 0402055 | 10/1973 | U.S.S.R. | 340/916 |

*Primary Examiner*—Brent Swarthout
*Attorney, Agent, or Firm*—Kenneth D. Baugh

[57] ABSTRACT

A traffic control system 10 is provided having an illuminating member 42 and a rotating drum 48. The drum 48 is provided with a red reflector 50, a green reflector 52 and a yellow reflector 54 formed on different portions thereof. A control channel 14 is provided for selectively rotating the drum 48 so that each reflector 50, 52 and 54 can be illuminated by the illuminating member 42 thus providing an indication whether a vehicle should stop, go or exercise caution. The traffic control system 10 is also provided with a monitoring channel 16 which monitors the control channel 14 to insure the circuit is operating properly.

10 Claims, 5 Drawing Sheets

TRAFFIC CONTROL SYSTEM

TECHNICAL FIELD

This invention relates to a traffic control system and more particularly to a traffic control system to be used to facilitate the signaling of drivers and pedestrians to control the flow of traffic on roads and highways. Traffic control and thus traffic signaling is very important in assuring the safety of a vehicle, its occupants and others who used the roadways. The common practice is to provide traffic signaling devices which indicate whether a vehicle should stop, go or exercise caution. Since providing the signals are important in assuring safety it is desirable to make these devices as reliable as possible by providing a reliable and cost effective control system and by providing a traffic device with the control system that is readily visible seen by drivers and pedestrians. Such signaling devices become even more important in a modern society such as ours where crowded road and highway conditions are the rule rather than the exception. Thus effective traffic signaling can be ever so important in contributing tributing to driver safety and helping to eliminate vehicle accidents.

BACKGROUND ART

Attempts have been made to provide traffic signaling devices for controlling automobile traffic. One such device is disclosed in U.S. Pat. No. 4,235,737. In this device a traffic device having a four sided housing, each one of which contains red and green areas which can be illuminated. Each side contains a rotating semicircular mask which simultaneously, progressively covers one portion of the colored areas and uncovers a portion of the other colored area until the illumination of the traffic light is changed. The rotation of the masks together with the activator of the various lights is controlled by a common ring gear. While this system does attempt to provide an illuminating device that is readily visible it does not provide a control system to sequentially control the illuminating device.

Another device is disclosed in U.S. Pat. No. 3,810,084. In this device the primary component is the control system for sequentially controlling an illuminating device. More particular the invention provides logic circuitry which provides a sequence of timed changing logic states which defines operating periods for a plurality of signal lights. While this system addresses the concern for having a traffic system with a reliable control system, it does not address the need to have a traffic system with an illuminating device that is readily visible.

DISCLOSURE OF THE INVENTION

The invention relates to a traffic control device. The traffic control device in accordance with the principles of this invention includes a housing having an opening formed therein. The device also includes a power source and an illuminating means, coupled to the power source and coupled in the housing in alignment with the opening formed in the housing. Additionally a reflector means is coupled for rotation in the housing. The reflector means is provided with first, second and third reflecting members. A means for rotating the reflector means is provided. Further a means is provided for selectively activating the rotating means so that each one of the reflecting members of the reflector means can be rotated into direct alignment with the opening in the housing and the illuminating means to thereby selectively illuminate each one of the reflecting members. The traffic control device also includes a means for monitoring the activating means to provide an indication when the activating means is inoperative.

BRIEF DESCRIPTION OF THE DRAWING

The details of the invention will be described in connection with the accompanying drawing in which.

BEST MODE FOR CARRYING OUT THE INVENTION

Figure 1:
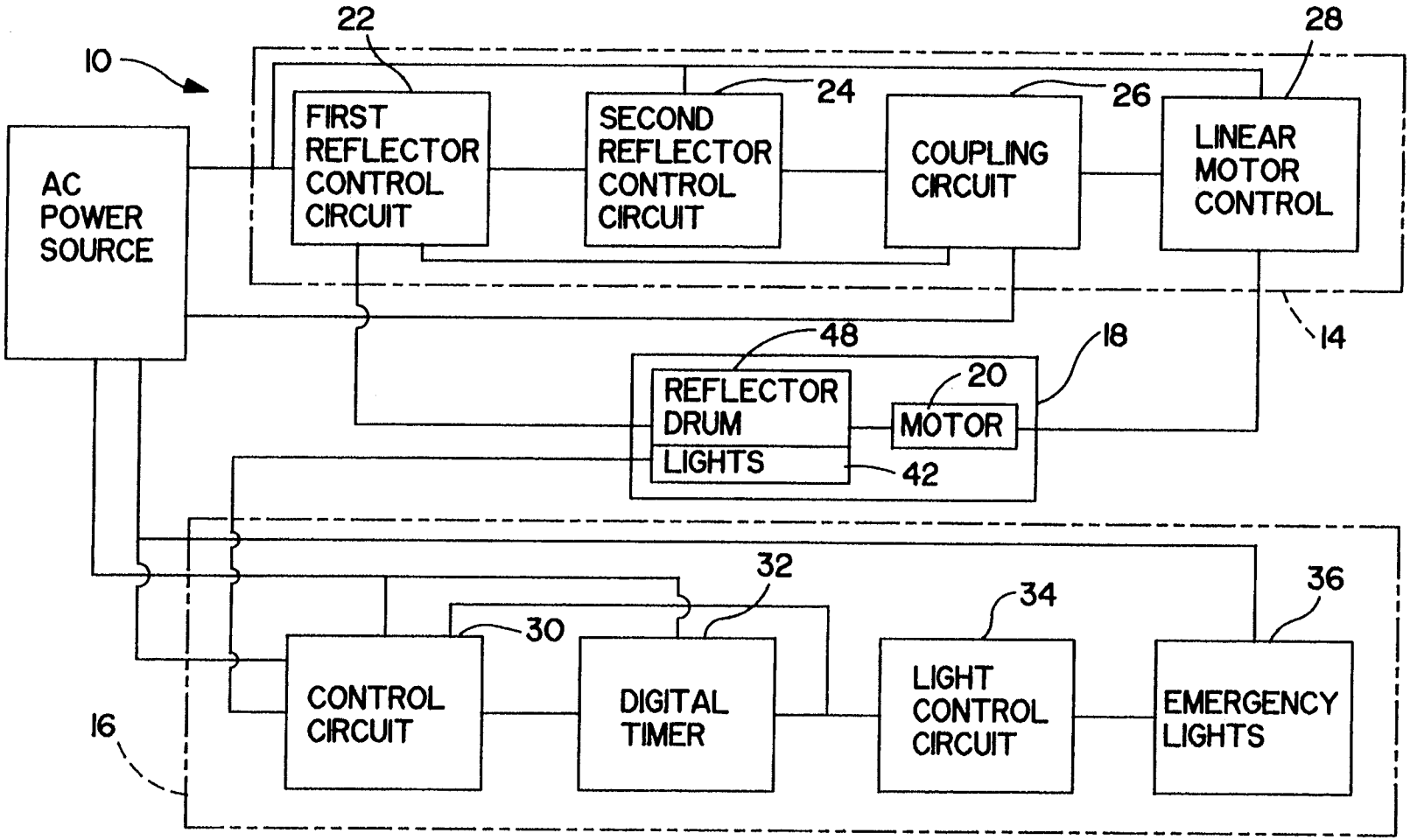
FIG. 1 is a block diagram illustrating the Traffic Control System in accordance with the principles of this invention.

Referring to FIG. 1 there is shown, a traffic control system, generally designated by the numeral, 10. The traffic control system 10 includes a voltage source, generally designated by the number 12 and a pair of electrical channels, generally designated by the numerals, 14 and 16 and a traffic device, generally designated by the numeral, 18 including a step motor 20. The voltage source 12 is electrically coupled to provide power to channels 14 and 16. The channel 14 is a control channel provided to control and activate the traffic device 18 while the channel 16 is a monitoring channel provided to monitor and diagnose the control channel 14 to insure the circuit is operating properly.

The control channel 14 of the traffic control system 10 includes a first reflector control circuit, generally designated by the numeral, 22, a second reflector control circuit,generally designated by the numeral, 24, a coupling circuit, generally designated by the numeral, 26 and a linear motor controller, generally designated by the numeral, 28.

The monitoring channel 16 of the traffic control system 10 includes a control circuit, generally designated by the numeral, 30, a digital timer 32, a light control circuit, generally designated by the numeral, 34 and an emergency flashing light 36.

Figure 2:
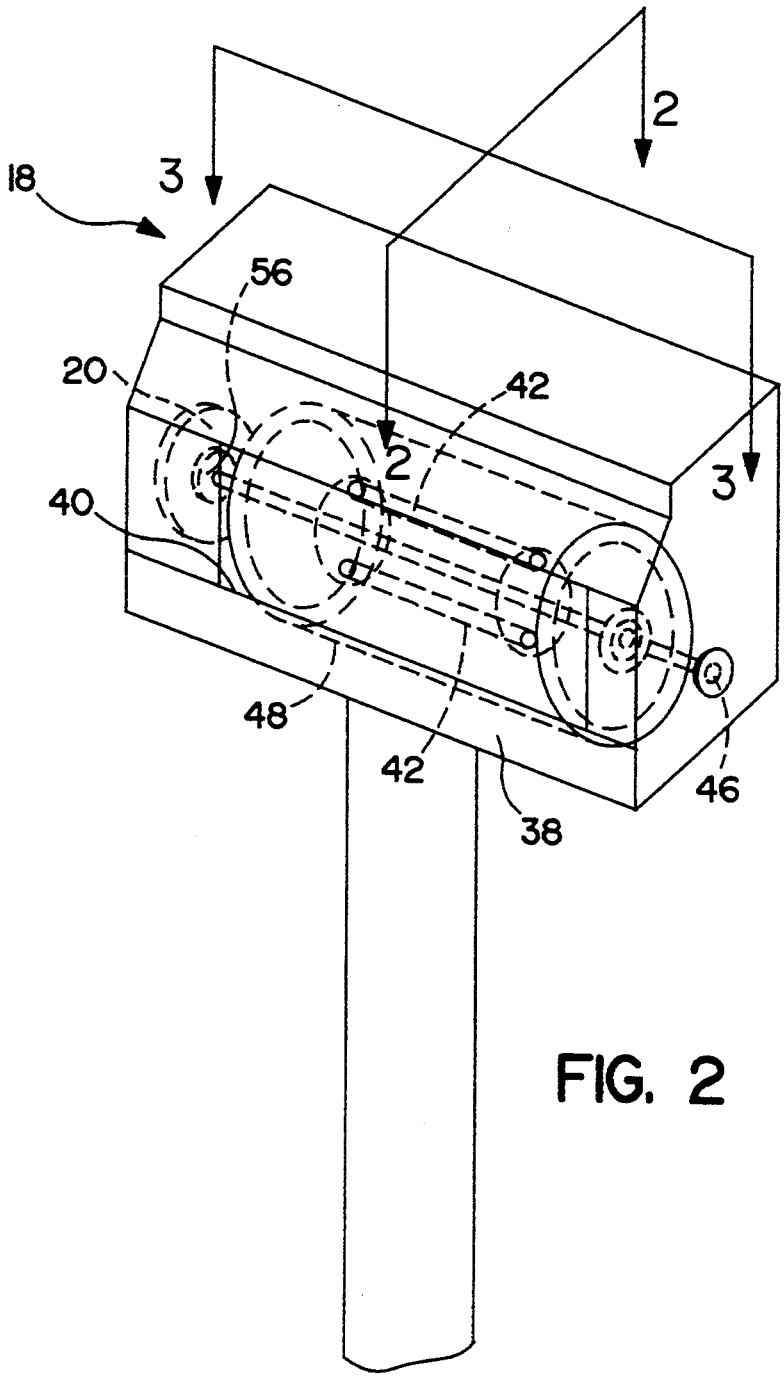
FIG. 2 is a perspective view illustrating the traffic device of the traffic control system of the block diagram of FIG. 1 in accordance with the principles of the invention.
Figure 4:
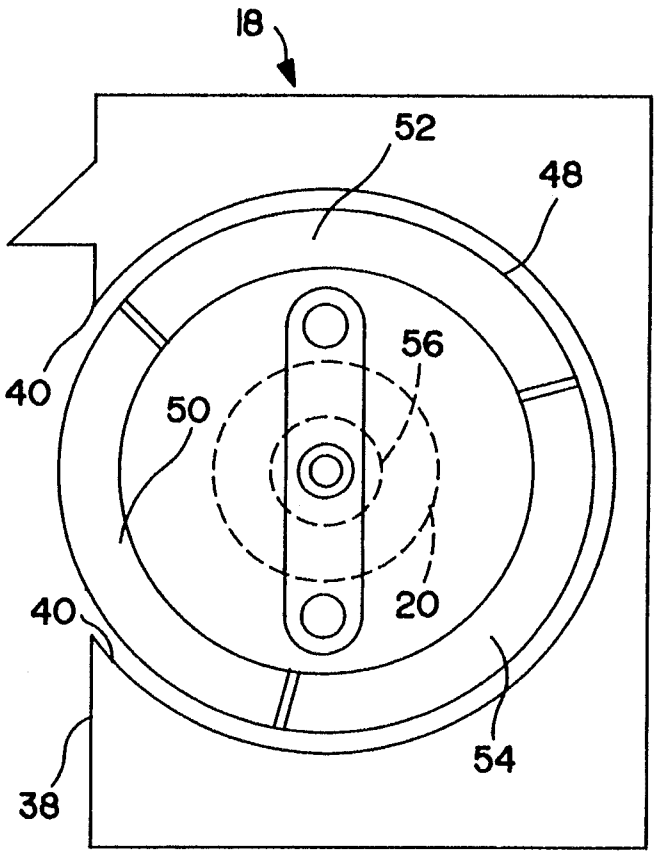
FIG. 4 is a sectional view of the traffic device illustrated in FIG. 2 taken along lines 4—4 in accordance with the principles of the invention.
Figure 3:
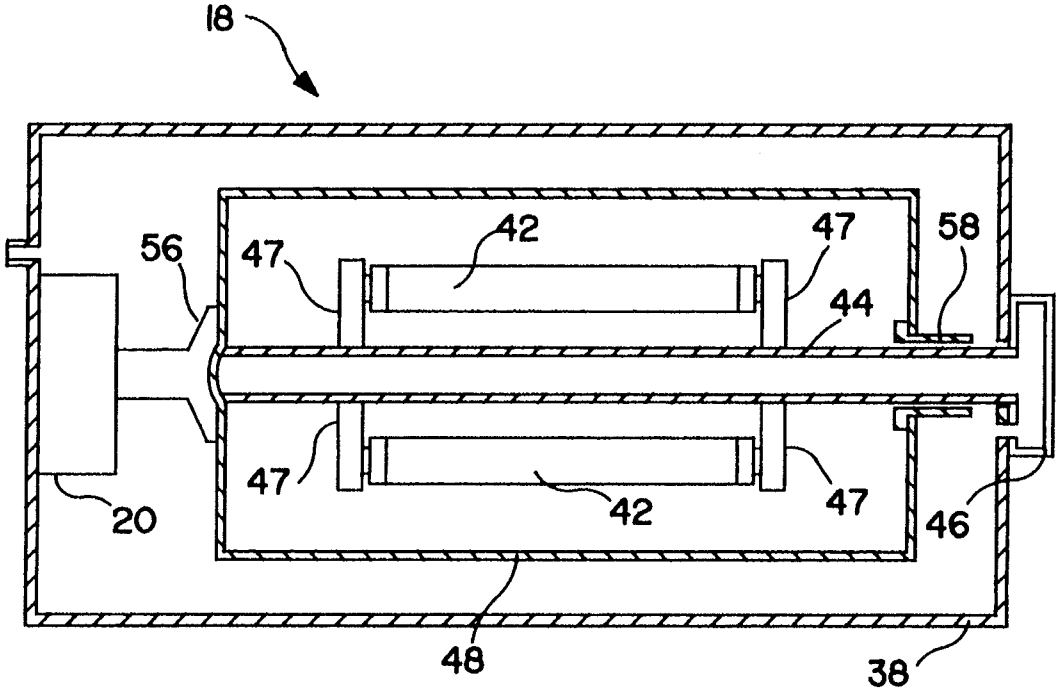
FIG. 3 is a sectional view of the traffic device in FIG. 2 taken along lines 33 in accordance with the principles of the invention.

Referring to FIGS. 2,3 and 4 the traffic device 18 is provided with a hollow housing 38 having an opening 40 formed therein. A pair of fluorescent lights 42 are mounted adjacent the opening 40 in the hollow portion of the housing 38 on a stationary shaft 44 which has an end member 46 coupled to the housing. The fluorescent lights 42 are mounted on the shaft by support members 47. The traffic device 18 is also provided with an oval shaped member or drum, generally designated by the numeral, 48 having three reflectors 50,52 and 54 coupled around the drum on different portions thereof. The reflectors 50, 52 and 54 conform to the colors of the normal traffic signaling device i.e. red, green, and yellow, respectively. The drum 48 is provided with a shaft member 56 at one end thereof which is coupled for rotation to the motor 20, mounted to the housing 38. The drum 48 also includes a sleeve member 58 at the other end thereof which rotates about the shaft 44 when the drum is rotating. The motor 20 rotates the drum 48 so that the reflectors 50, 52, and 54 can be rotated into the opening 40 in the housing 38 to a position directly adjacent the lights 40 to be illuminated by the lights when in that position.

Figure 5:
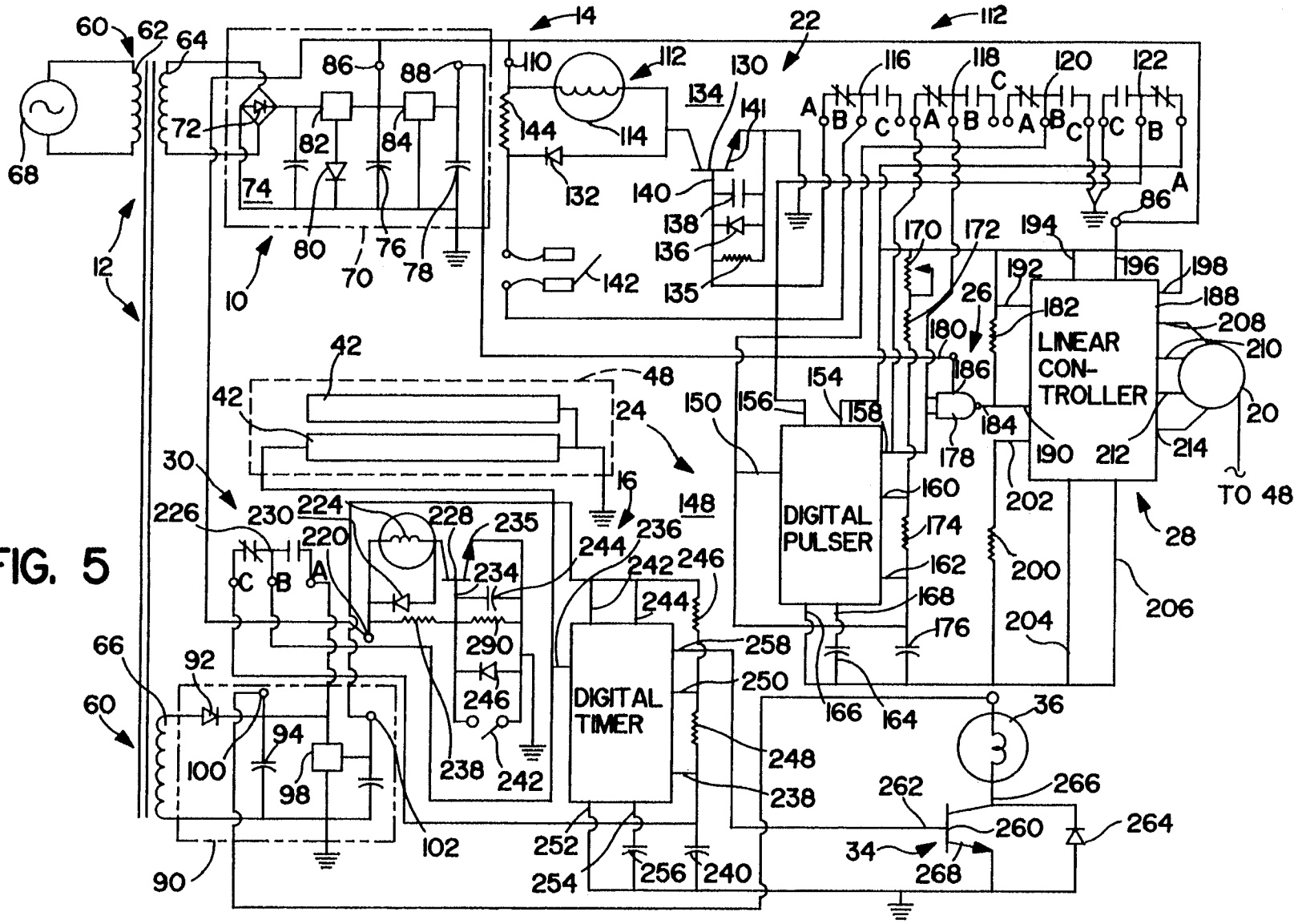
FIG. 5 is a schematic diagram illustrating the various circuit components of the block diagram of FIG. 1 in accordance with the principles of this invention.

Referring to the circuit schematic illustrated in FIG. 5 the power source 12 of the traffic control system 10 is provided with a transformer 60 having a primary winding 62 and first and second secondary windings 64 and 66, respectively. The primary winding 62 is coupled to a 110 volt AC power source 68. Circuit 70 for converting an alternating current voltage to a direct current voltage is coupled to the first secondary winding 64 of the transformer 60. The conversion circuit 70 includes a diode bridge 72, filter capacitors 74, 76, and 78 for filtering out unwanted frequencies, 12 volt and 5 volt voltage regulators 82 and 84 respectively and a temperature compensating diode 80 which assures that ambient temperature changes don't affect the voltage regulator 82. The conversion circuit 70 which functions in a well known manner provides a 12 volt voltage supply 86 and a 5 volt voltage supply 88 to activate the control channel 14 of the traffic control system 10.

The second secondary winding 66 of the transformer 60 is coupled to a circuit 90 for converting an alternating current voltage supply to a direct current voltage supply. The circuit 90 includes a rectifying diode 92, filter capacitors 94 and 96 and a voltage regulator 98. The circuit 90 provides a 24 volt voltage supply 100 and a 12 volt voltage supply 102 to provide the required voltage supplies to activate the monitoring channel 16 of the traffic control system 10.

The 12 volt voltage supply 86 of the power source 12 is coupled to the control channel 14 at an input terminal 110 of the first reflector control circuit 22. The reflector control circuit 22 includes a time delay relay 112 having a coil or relay winding 114 and normally opened and normally closed relay contacts, 116, 118, 120 and 122. The time delay rely 112 is provided with a preset predetermined time delay. The time delay relay 112 is provided to control the time at which the yellow reflector 54 is aligned adjacent to the lights 42. The reflector control circuit 22 also includes a transistor 130 for energizing the time delay relay 112. The winding 114 of the relay 112 and a catch diode 132 are coupled from the 12 volt power supply 86 to the collector 134 of the transistor 130. The catch diode 132 is a suppression diode provided to protect the collector 134 from negative going transient signals which may be generated when the coil 114 is energized. A resistor 135, diode 136 and capacitor 138 are coupled from the base 140 of the transistor 130 to ground. The base 140 of the transistor 130 is also coupled to a terminal 116A of the normally closed relay contact 116. The emitter 141 of the transistor 130 is coupled to ground. The other terminal 116B of the relay contact 116 is coupled to the 12 volt power supply 86 through a limit switch 142 and resistor 144. The resistors 135 and 144 form a voltage divider to a provide bias voltage for the base 140 of the transistor 130. The diode 136 and capacitor 138 are transient suppressors to protect the base 140 of the transistor 130 from negative going transients generated by the limit switch 142. The limit switch 142 is attached to the housing 38 and is activated by a magnetic sensor 146 attached to the yellow reflector 54. When the limit switch 142 is activated the transistor 130 is turned on to energize the time delay relay 112.

The second reflector control circuit 24 electrically interfaces with the first reflector control circuit 22 to control the time the red and green reflectors 50 and 52, respectively, are aligned adjacent to the lights 42. The second reflector control circuit 24 includes a digital pulser 148. The digital pulser 148 is coupled at an input terminal 150 and an output terminal 162 to the first reflector control circuit 22 at a terminal 120B of the normally open relay contact 120 of the relay 112 and then to ground through terminal 120C. The digital pulser 148 is coupled at terminals 154 and 156 to the control circuit 22 at terminals 122A and 122B, respectively, of the normally closed relay contact 122 which is coupled to ground through terminal 122C. The terminal 154 of the digital pulser 148 is also coupled to the 12 volt voltage supply 86.

The second reflector control circuit 24 also includes a timing circuit, generally designated, by the numeral 158 which sets the timing for the digital pulser 148. The timing circuit 158 includes a variable resistor 170, resistors 172 and 174 and a capacitor 176 which are coupled between the 12 volt voltage supply 86 and ground and to the digital pulser 148 at terminals 160 and 162. The values of variable resistor 170, resistor 172 and 174 and capacitor 176 are chosen to conform to the light timing sequence requirements of the local traffic department. The terminal 166 of the digital pulser is coupled to ground. The second reflector control circuit 24 is also provided with a capacitor 164 which is coupled from terminal 168 of the digital pulser 148 to ground to supply a static control voltage to the digital pulser.

The coupling circuit 26 of the control channel 14 is provided to electrically interface with the first and second reflector control circuits 22 and 24, respectively. The coupling circuit 26 includes a nand gate 178. The nand gate 178 is coupled at an input terminal 180 thereof to the digital pulser 148 at terminal 158 thereof through relay contact 118 at terminal 118B and 118A, respectively. The coupling circuit 26 is also provided with a pull up resistor 182 which is coupled between the 12 volt voltage supply 86 and an output terminal 184 of the nand gate 178. The 5 volt voltage supply 88 supplies power to the nand gate 178 at terminal 186 thereof.

The linear motor controller 28 includes a linear controller 188 which is provided to send control signals to activate the motor 20.

The linear controller 188 is coupled to the output terminal 184 of the nand gate 178 at an input terminal 190 thereof. The 12 volt voltage supply 86 is coupled to terminals 192, 194, 196 and 198, of the linear controller to provide the required power for activation thereof. The linear motor controller 28 also includes a bias resistor 200 which is coupled from terminal 202 of the linear controller 188 to ground. Terminals 204 and 206 of the linear controller 188 are coupled directly to ground. Output terminals 208, 210, 212 and 214 of the linear controller 188 are coupled to the step motor 20 to transmit signals from the linear controller to the motor.

The monitoring channel 16 of the traffic control system 10 is coupled to the 12 volt supply voltage 86 at terminal 220 of the control circuit 30. The control circuit 30 includes a relay 222 having a relay coil or winding 224 and a normally open and normally closed relay contact 226. The control circuit 30 also includes a transistor 228 for energizing the relay 222. The coil 224 of the relay 222 and a diode 230 for suppressing transients from the coil are coupled between the 12 volt voltage supply 86 and the collector 232 of the transistor 228.

The bias voltage to base 234 of the transistor 228 is provided by a resistor divider including a resistor 238 which is coupled from the 12 volt voltage supply 86 to the transistor base, and a resistor 240 which is coupled from the base to ground. A switch 242 may also be coupled between the transistor base 234 and ground. A capacitor 244 and diode 246 are also coupled from the transistor base 234 to ground. The emitter 235 of the transistor 230 is also coupled to ground. The capacitor 244 and diode 246 are transient suppressors to protect the base 234 of the transistor 230 from negative going transients generated by the switch 242. The switch 242 is provided to manually energize the monitoring channel 16 when desired. The control circuit 30 is coupled to the 24 volt voltage supply 100 through the terminal 226A of the normally open relay contact 226.

The control circuit 30 is coupled from the terminal 226B of the relay contact 226 to the digital timer 32, at an input terminal 236 thereof, and to the lights 42. The terminal 226C of the relay contact 226 is coupled to a terminal 238 of the digital timer 32 and to ground through a capacitor 240. The terminals 242 and 244 of the digital timer 32 are coupled to the 12 volt voltage supply 102.

The timing for the digital timer 32 is set by resistor 246, resistor 248 and capacitor 240, which are coupled between the 12 volt voltage supply 102 and ground and to the digital timer, at terminals 238 and 250. The timing for the digital timer 32 determines the flashing rate of the flashing light 36. Terminal 252 of the digital timer 32 is coupled directly to ground and terminal 254 is coupled to ground through capacitor 256 which supplies a static control voltage to the digital timer.

The light control circuit 34 in the monitoring channel 16 is provided with a transistor 260 for activating the emergency flashing light 36. The transistor 260 is electrically coupled at the base 262 thereof to the digital timer 32 at terminal 258. The light control circuit 34 is also provided with a diode 264 which is coupled from the collector 266 of the transistor 260 to ground. The diode 264 protects the collector 266 of the transistor from transients caused by the flashing light 36. The emitter 268 of the transistor 260 is also coupled to ground.

The emergency flashing light 36 is coupled between the 24 volt voltage supply 100 and the collector 266 of the transistor 260 so that it can be activated upon activation of the transistor by the digital timer 32.

The traffic control system 10 is based on three colored rotating reflectors, that is, a red reflector 50, a green reflector 52 and yellow reflector 54 which rotate about the fluorescent lights 42 for illumination.

When it is desired to operate the traffic control system 10 the desired reflector 50, 52 or 54 can be manually set to reflect the desired color before power is applied to the system. For example, if red is the desired color then the red reflector 50 is rotated in position in the opening 40 of the housing 38. When power is applied the fluorescent lights 42 turn on thereby illuminating the red reflector 50. The duration for which the red reflector 50 remains illuminated depends on the digital pulser 144.

Figure 6:
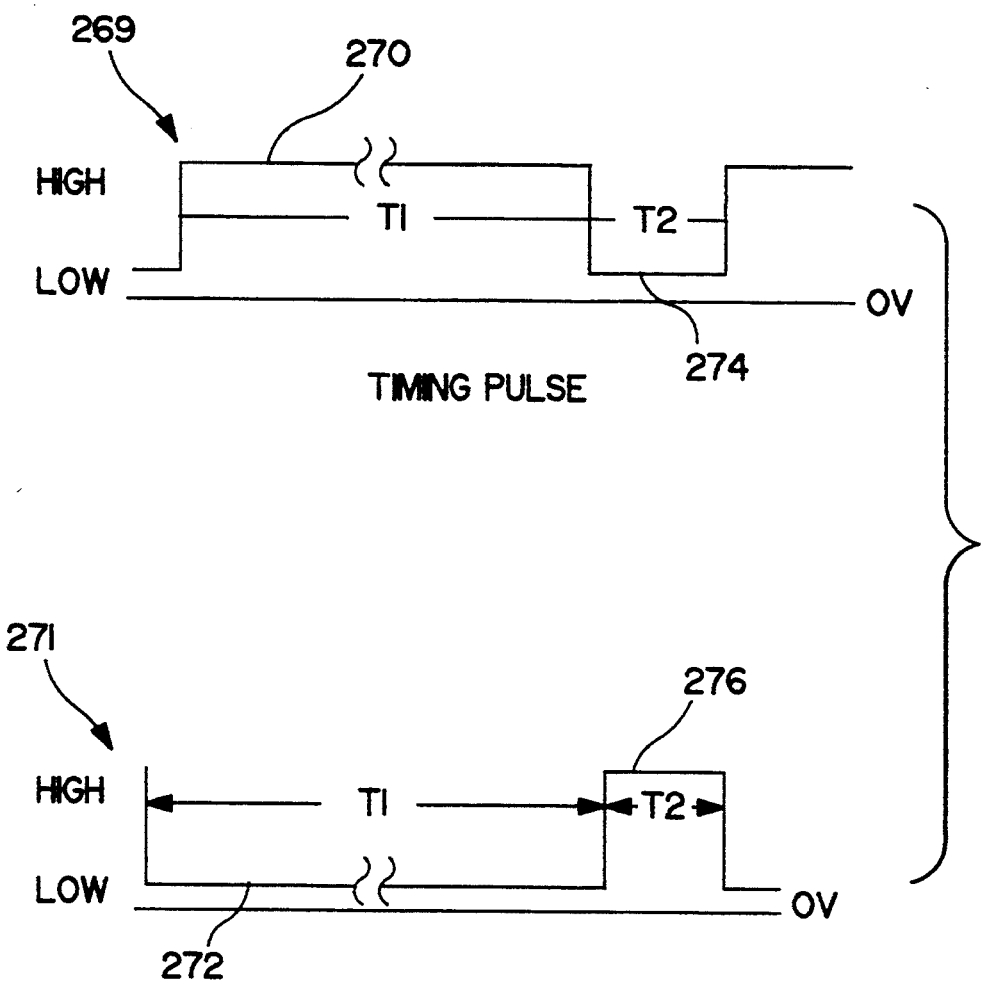
FIG. 6 is a timing diagram illustrating timing pulses required for operation of the traffic control system in accordance with the principles of this invention.

Referring to FIG. 6 and the timing pulse, generally designated by the numerals, 269 and 271, respectively, during the time interval T1 a logic high signal 270 is transmitted from terminal 158 of the digital pulser 144 and thus a logic low signal 272 is seen at terminal 190 of the linear controller 188. This allows the red reflector 50 to stay visible.

At the end of time interval T1 and the start of time interval T2 a logic low signal 274 is transmitted from terminal 158 of the digital pulser 144 and a logic high signal 276 is transmitted to terminal 190 of the linear controller 188.

At this time the linear controller 188 sends a command to the motor 20 to rotate. This command causes the motor 20 to rotate 120 degrees very quickly to align the green reflector 52 in the housing opening 40 adjacent to the lights 42 thereby illuminating the green reflector. The logic signal 276 at terminal 190 then falls to the logic low, signal 272. The green reflector 52 will remain illuminated until the next time interval T2 when the logic high signal 276 appears again at terminal 190 of the linear controller 188.

When the logic high signal 276 appears again at terminal 190 of the linear controller 188 this causes the linear controller to send a command signal to the motor 20 to rotate 120 degrees to align the yellow reflector 54 in the housing opening 40 adjacent the lights 42 there by illuminating the yellow reflector. When the yellow reflector 54 is aligned for illumination by the lights 42 the magnetic sensor 146 that is attached to the yellow reflector engages the limit switch 142. The limit switch 142 will then close thereby causing the transistor 130 to be turned on activating the time delay relay 112. When the time delay relay 112 is turned on the coil 114 of the time delay relay is energized. As a result all of the normally closed contacts of the relay 112 become open and the normally open contacts of the relay become closed. The digital pulser 144 then turns off thus disconnecting the nand gate 180 from the digital pulser. The yellow reflector 54 will remain in place and illuminated until the preset time of the time delay relay 112 is reached. The delay time of the relay 112 is determined by the local traffic department.

Once the present delay time of the relay 112 is reached transistor 130 turns off again causing the relay to be deenergized. At this point the relay contacts revert to their deenergized position that is the normally closed contacts closed and the normally opened contacts opened, thus restarting the digital pulser 144. As the digital pulser 144 restarts the logic high signal 276 during time interval T2 is seen at terminal 190 of the linear controller 188 thereby causing the motor 20 to rotate again placing the red reflector 50 in the illuminating position. Then the whole cycle restarts.

While the control channel 14 of the traffic control system 10 is operating the 12 volt DC voltage supply 86 that supplies the bias for the channel 14 is monitored for any noticeable drop in the voltage level by monitoring channel 16. This is accomplished by applying the 12 volt voltage supply 102 which is a sample of the voltage supply 86 to the collector 232 of transistor 228 through the coil 224 of the relay 222. When power is initially applied to the traffic light control system 10 the transistor 228 will cause the relay 222 to be energized thereby closing the normally open contact and opening the normally closed contact of the relay. This will cause the lights 42 to be turned on and the digital timer 32 to be disconnected. When the digital timer 32 is disconnected the transistor 260 is turned off and the emergency flashing light 36 kept off.

If the 12 volt voltage supply 86 is absent or low the relay 222 will not be energized. As a result the normally open contact of the relay 222 will remain open and the lights 42 will not come on. At the same time the normally closed contact of the relay 222 will remain closed thus starting the digital timer 32 which in turn will send timing pulses to the base 262 of the transistor 228 to activate the transistor and cause the emergency flashing light 36 to flash.

The monitoring feature of the monitoring channel 16 may also be applied manually by closing the emergency switch 242 which will in turn deactivate the lights 42 and cause the emergency flashing light 36 to flash.

The invention has been shown and described in what is considered to be the most practical and preferred embodiment. However, it should be recognized that changes may be made by those skilled in the art without departing from the spirit and scope of the invention.

We claim:

1. A traffic control device including:

a housing having an opening formed therein;

a first power source;

an illuminating means coupled to the first power source and coupled in the housing in alignment with the opening formed therein;

reflector means rotably coupled in the housing having first, second and third reflecting members;

means for rotating the reflector means;

means for activating the rotating means so that each one of the reflecting members of the reflecting means can be selectively rotated into direct alignment with the opening in the housing and the illuminating means to selectively illuminate each one of the reflecting members, the means for activating the rotating means including a second power source;

a first means coupled to the second power source for generating a first and a second signal of predetermined durations during different predetermined time intervals;

a second means coupled to the second power source for generating a third signal of a predetermined duration during a still different predetermined time interval;

a third power source;

a third means coupled to the second and third power source and responsive to the first signal for sending signals to the rotating means to rotate the rotating means to a first, a second and a third position during selected ones of the different time intervals, and responsive to the second signal for sending signals to the rotating means to maintain the rotating means in the first and second positions during other ones of the different time intervals for a predetermined time and responsive to the third signal for sending a signal to the rotating means to maintain the rotating means in the third position during a still different time interval for a predetermined time; and means for monitoring the activating means to provide an indication when the activating means is inoperative, the monitoring means including, means coupled to the first power source for indicating when the second power source is below a predetermined level;

a first means responsive to the second power source for generating a first signal when the second power source is at a predetermined level and for generating a second signal when the second power source is below the predetermined level;

a fourth power source of the same voltage level as the second power source; and a second means coupled to the fourth power source and responsive to the first means for activating the indicating means when the second signal is generated by the first means and for deactivating the indicating means when the first signal is generated by the first means.

2. A traffic control device as defined in claim 1 wherein the illuminating means includes:

a shaft mounted in the housing; and at least one fluorescent light coupled to the shaft.

3. A traffic control device as defined in claim 2 wherein the first signal generating means includes:

a digital pulser circuit; and a timing circuit coupled to the digital pulser circuit.

4. A traffic control device as defined in claim 3 wherein the second signal generating means includes:

a time delay relay; and a transistor for activating the time delay relay.

5. A traffic control device as defined in claim 4 wherein the third means includes:

a nand gate; and a linear controller coupled to the nand gate.

6. A traffic control device as defined in claim 5 wherein the first means of the monitoring means includes:

a relay; and a transistor for activating the relay.

7. A traffic control device as defined in claim 6 wherein the second means of the monitoring means includes:

a digital timer;

a timing circuit coupled to the digital timer; and a transistor coupled to the digital timer.

8. A traffic control device as defined in claim 7 wherein the indicating means of the monitoring means includes a flashing light.

9. A traffic control device as defined in claim 8 wherein the reflector means includes:

a drum;

a shaft coupled to the drum;

a red reflecting member coupled to a first portion of the drum;

a green reflecting member coupled to a second portion of the drum; and a yellow reflecting member coupled to a third portion of the drum.

10. A traffic control device as defined in claim 9 wherein the means for rotating the reflector means includes a motor rotably coupled to the shaft of the drum.

* * * * *